US008550152B2

(12) United States Patent
Beutler et al.

(10) Patent No.: US 8,550,152 B2
(45) Date of Patent: Oct. 8, 2013

(54) METALLIC HEAT EXCHANGER TUBE

(75) Inventors: Andreas Beutler, Weissenhorn (DE); Jean El Hajal, Ulm (DE); Achim Gotterbarm, Dornstadt (DE); Ronald Lutz, Blaubeuren (DE)

(73) Assignee: Wieland-Werke AG, Ulm (DE)

( * ) Notice: Subject to any disclaimer, the term of this patent is extended or adjusted under 35 U.S.C. 154(b) by 873 days.

(21) Appl. No.: 12/661,588

(22) Filed: Mar. 19, 2010

(65) Prior Publication Data

US 2010/0288480 A1 Nov. 18, 2010

(30) Foreign Application Priority Data

May 14, 2009 (DE) ..... 10 2009 021 334

(51) Int. Cl.
*F28F 1/36* (2006.01)
*F28F 1/42* (2006.01)

(52) U.S. Cl.
USPC ..... 165/133; 165/179; 165/184

(58) Field of Classification Search
USPC ..... 165/184
See application file for complete search history.

(56) References Cited

U.S. PATENT DOCUMENTS

| | | | | |
|---|---|---|---|---|
| 3,202,212 | A * | 8/1965 | Kritzer | 165/179 |
| 3,326,283 | A | 6/1967 | Ware | |
| 4,194,384 | A * | 3/1980 | Fujie et al. | 165/133 |
| 4,216,826 | A * | 8/1980 | Fujikake | 165/133 |
| 4,549,606 | A * | 10/1985 | Sato et al. | 165/184 |
| 4,660,630 | A | 4/1987 | Cunningham et al. | |
| 5,669,441 | A * | 9/1997 | Spencer | 165/184 |
| 6,167,950 | B1 * | 1/2001 | Gupte et al. | 165/133 |
| 2002/0189790 | A1 * | 12/2002 | Wong | 165/133 |
| 2007/0034361 | A1 * | 2/2007 | Lu et al. | 165/133 |
| 2007/0131396 | A1 | 6/2007 | Yu et al. | |
| 2007/0151715 | A1 * | 7/2007 | Yunyu et al. | 165/133 |
| 2008/0196876 | A1 | 8/2008 | Cao et al. | |

FOREIGN PATENT DOCUMENTS

| | | | |
|---|---|---|---|
| CN | 101004337 | A | 7/2007 |
| DE | 44 04 357 | C2 | 3/1995 |

* cited by examiner

*Primary Examiner* — Leonard R Leo
(74) *Attorney, Agent, or Firm* — Flynn, Thiel, Boutell & Tanis, P.C.

(57) ABSTRACT

A metallic heat exchanger tube (1) with a tube wall (2) and with integrally formed ribs (3) which run around on the tube outside (21) and which have a rib foot (31), rib flanks (32) and a rib tip (33), the rib foot (31) projecting essentially radially from the tube wall (2), and the rib flanks (32) being provided with additional structural elements which are formed as material projections (4) arranged laterally on the rib flank (32), the material projections (4) having a plurality of boundary faces (41, 42), at least one of the boundary faces (42) of at least one material projection (4) being curved convexly.

7 Claims, 4 Drawing Sheets

METALLIC HEAT EXCHANGER TUBE

BACKGROUND OF THE INVENTION

The invention relates to a metallic heat exchanger tube.

Metallic heat exchanger tubes of this type are used, in particular, for the condensation of liquids from pure substances or mixtures on the tube outside. Condensation occurs in many sectors of refrigeration and air conditioning technology and also in process and energy engineering. Tube bundle heat exchangers are often used, in which vapors from pure substances or mixtures are liquefied on the tube outside and at the same time heat a brine or water on the tube inside. Such appliances are designated as tube bundle condensers or tube bundle liquefiers.

The heat exchanger tubes for tube bundle heat exchangers usually possess at least one structured region and also smooth end pieces and, if appropriate, smooth intermediate pieces. The smooth end or intermediate pieces delimit the structured regions. So that the tube can be installed in the tube bundle heat exchanger without difficulty, the outside diameter of the structured regions should be no larger than the outside diameter of the smooth end and intermediate pieces. The high-performance tubes customary nowadays are somewhat more efficient than smooth tubes of the same diameter by about the factor four.

Various measures are known for increasing the heat transfer during the condensation on the tube outside. Ribs are often attached on the outer surface of the tube. As a result, primarily, the surface of the tube is enlarged, and consequently condensation is intensified. For the heat transmission, it is especially advantageous if the ribs are formed from the wall material of the smooth tube, since there is then optimal contact between the rib and tube wall. Ribbed tubes in which the ribs have been formed from the wall material of a smooth tube by means of a forming process are designated as integrally rolled rib tubes.

It is prior art to enlarge the surface of the tube further by the introduction of notches into the rib tips. Furthermore, due to the notches, additional structures arise which positively influence the condensation process. Examples of notches for rib tips are known from the publications U.S. Pat. Nos. 3,326,283 and 4,660,630.

Commercially obtainable ribbed tubes for liquefiers nowadays possess on the tube outside a ribbed structure with a rib density of 30 to 45 ribs per inch. This corresponds to a rib division of approximately 0.85 to 0.56 mm. Ribbed structures of this type may be gathered, for example, from the publications DE 44 04 357 C2, US 2008/0196776 A1, US 2007/0131396 A1 and CN 101004337 A. Limits are placed on the further rise in performance as a result of an increase in the rib density by the inundation effect which occurs in tube bundle heat exchangers: with a decrease in spacing of the ribs, the interspace between the ribs is flooded with condensate due to the capillary effect, and the flow-off of the condensate is impeded due to the fact that the channels between the ribs become smaller.

Furthermore, it is known that increases in performance can be achieved in liquefier tubes in that, with the rib density remaining the same, additional structural elements are introduced between the ribs in the region of the rib flanks. Such structures may be formed by gearwheel-like disks on the rib flanks. The material projections which in this case occur project into the interspace between adjacent ribs. Embodiments of such structures are found in the publications US 2008/0196876 A1, US 2007/0131396 A1 and CN 101004337 A. These publications show the material projections as structural elements with planar boundary faces. The planar boundary faces are a disadvantage, since the condensate formed does not experience, on a planar face, a force which is induced by the surface tension and which would remove it from the boundary face. An undesirable liquid film is therefore formed, which may persistently obstruct the transmission of heat.

BRIEF SUMMARY OF THE INVENTION

The object on which the invention is based is to develop a heat exchanger tube of increased performance for the condensation of liquids on the tube outside, with the tube-side heat transfer and pressure drop being the same and with the production costs being the same. The mechanical stability of the tube should in this case not be adversely influenced.

The invention is reproduced by the claimed features which relate to advantageous refinements and developments of the invention.

The invention includes a metallic heat exchanger tube with a tube wall and with integrally formed ribs which run around on the tube outside and which have a rib foot, rib flanks and a rib tip, the rib foot projecting essentially radially from the tube wall, and the rib flanks being provided with additional structural elements which are formed as material projections which are arranged laterally on the rib flank, the material projections having a plurality of boundary faces.

According to the invention, at least one of the boundary faces of at least one material projection is curved convexly.

The present invention relates to structured tubes in which the heat transfer coefficient is intensified on the tube outside. Since the main proportion of the heat transmission resistance is thereby often displaced into the inside, the heat transfer coefficient usually likewise has to be intensified on the inside. A rise in the heat transfer on the tube inside normally results in an increase in the tube-side pressure drop.

The invention in this case proceeds from the consideration that the integrally rolled rib tube has a tube wall and ribs running around helically on the tube outside. The ribs possess a rib foot, a rib tip and, on both sides, rib flanks. The rib foot projects essentially radially from the tube wall. The height of the rib is measured from the tube wall as far as the rib tip and preferably amounts to between 0.5 and 1.5 mm. The contour of the rib is curved concavely in the radial direction in the region of the rib foot and also in that region of the rib flank which adjoins the rib foot. The contour of the rib is curved convexly in the radial direction at the rib tip and also in that region of the rib flank which adjoins the rib tip. The convex curvature merges into a concave curvature approximately at rib mid-height. In the region of the convex curvature, condensate which occurs is drawn away on account of surface tension forces. The condensate collects in the region of the concave curvature and forms drops there.

According to the invention, additional structural elements in the form of material projections are formed laterally on the rib flanks. These material projections are formed from material of the upper rib flank, in that, by means of a tool, the material is lifted off in a similar way to a chip and displaced, but is not separated from the rib flank. The material projections remain connected fixedly to the rib. A concave edge arises between the rib flank and material projection at the connection point. The material projections extend essentially in the axial direction from the rib flank into the interspace between two ribs. The material projections may, in particular, be arranged approximately at rib mid-height. The surface of the tube is enlarged by means of the material projections.

Opposite material projections of adjacent ribs should not touch one another. Usually, therefore, the axial extent of the material projections is somewhat smaller than half the width of the interspace between two ribs. For example, in the case of liquefier tubes for the refrigerant R134A or R123, the width of the interspace between two ribs amounts to approximately 0.4 mm, as a result of which the axial extent of the material projections is consequently smaller than 0.2 mm.

According to the invention, the material projections are delimited by at least one convexly curved face. Owing to the convex shape, the action of the additional structural elements is improved. On account of the surface tension, the condensate is drawn away from convexly curved faces and is drawn toward the concave edge at the onset point between the material projection and rib flank. The condensate film on the convexly curved boundary face of the material projection is therefore thinner and the thermal resistance is lower. The material projections are arranged approximately in that region of the rib flank in which the convexly curved contour of the rib merges into the concavely curved contour. Condensate from the upper region of the rib and condensate from the material projection meet at the onset point and form a drop in the concavely shaped part of the rib.

The additional structures illustrated in US 2007/0131396 A1 and US 2008/0196876 A1 and attached laterally to the rib flanks are elements with planar faces which do not have advantageous properties of this kind.

The particular advantage is that, by virtue of an intensification of the heat transfer on the tube inside, along with a favorable heat transfer on the tube outside, the size of the liquers can be greatly reduced. The production costs of such appliances consequently fall. At the same time, neither the mechanical stability of a tube nor the pressure drop are adversely influenced by the solution according to the invention. Moreover, there is a fall in the necessary refrigerant filling quantity which, in the case of the chlorine-free safety refrigerants predominantly used today, may amount to an appreciable fraction of the overall plant costs. Furthermore, in the case of the toxic or combustible refrigerants normally used only in special circumstances, the risk potential can be lowered by the filling quantity being reduced.

In a preferred refinement of the invention, the local radius of curvature of the convex boundary face may be reduced with an increasing distance from the rib flank. At any point on the convex boundary face, a local radius of curvature may be defined as the radius of the osculating circle. The osculating circle lies in this case in a plane oriented perpendicularly to the rib flank. This local radius of curvature changes according to the shape of the boundary face. If such a face is covered with a liquid film pressure gradients arise in the liquid film on account of the surface tension and because of the changing radius of curvature. These pressure gradients draw the liquid away from regions with a small radius of curvature and toward regions with a large radius of curvature. Versions of the material projections are particularly advantageous when the local radius of curvature of their boundary face becomes smaller with an increasing distance from the rib flank. The condensate is then drawn especially efficiently away from those regions of the material projections which are distant from the rib flank and is transported toward the rib.

Advantageously, the convexly curved boundary face may be that boundary face of the material projection which faces away from the tube wall. The vapor to be condensed can then flow, unimpeded, onto this face.

In an advantageous refinement of the invention, the curvature of the boundary face may also be curved convexly in a plane parallel to the rib flank, the curvature of the convex boundary face in a plane perpendicular to the rib flank being greater than the curvature in the convex boundary face in the plane parallel to the rib flank. The transport of the condensate in the lateral direction from the tip of the material projection toward the rib is thereby additionally assisted.

The radius, designated as the mean radius of curvature of the convex boundary face, of an imaginary circle can be determined by means of measurements at three points. In a particularly preferred embodiment, the radius of this imaginary circle, which lies in a sectional plane perpendicular to the tube circumferential direction and is defined by the points P1, P2 and P3, may be smaller than 1 mm. P1 is the point at which the convex boundary face of the material projection is contiguous to the rib flank, P3 is the point at which the convex boundary face of the material projection is furthest away from the rib flank, and P2 is the center point between P1 and P3 on the contour line of the convex boundary face of the material projection. If this radius of curvature were greater than 1 mm, the surface tension forces resulting in the case of the substances normally used, such as, for example, refrigerants or hydrocarbons, would not be sufficiently high with respect to gravity in order to influence the transport of the condensate decisively.

Advantageously, the convex boundary face of the material projection may be continued, in the region of the tip of the latter, with the convex curvature beyond the point P3 furthest away from the rib flank. In this case, the tip of the material projection is then mostly curved spirally. As a result, further surface for the condensation is obtained in the available interspace between the ribs, while the rib spacing remains the same.

In a preferred embodiment of the invention, the material projections arranged on the rib flank may be spaced apart in the circumferential direction. This gives rise to additional edges at which condensation takes place. Furthermore, the condensate collecting on the rib flank can flow off toward the rib foot in the regions between two material projections.

In a following advantageous refinement of the invention, the material projections arranged on the rib flank may be spaced apart equidistantly and at least by the amount of their width in the circumferential direction. Sufficient interspace for the condensate collecting on the rib flank is thereby afforded in order to ensure that this is transported

BRIEF DESCRIPTION OF THE DRAWINGS

Exemplary embodiments of the invention are explained in more detail by means of the diagrammatic drawings. In these.

DETAILED DESCRIPTION OF THE INVENTION

Parts corresponding to one another are given the same reference symbols in all the figures.

Figure 1:
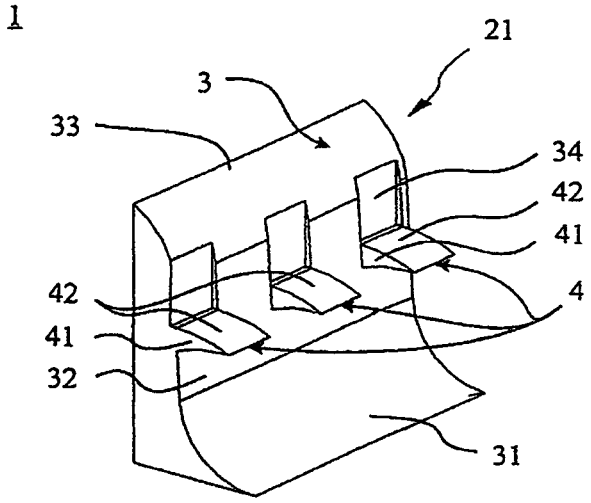
FIG. 1 shows a perspective part view of a ribbed portion of a heat exchanger tube with material projections.

FIG. 1 shows a perspective part view of a ribbed portion of a heat exchanger tube 1 with three material projections 4. Of the tube outside 21, only part of the integrally formed ribs 3 running around is depicted. The ribs 3 have a rib foot 31 which starts on the tube wall, not illustrated here, rib flanks 32 and a rib tip 33. The rib 3 projects essentially radially from the tube wall. The rib flanks 32 are provided with the additional structural elements which are formed as material projections 4 which start laterally on the rib flank 32. These material projections 4 have a plurality of boundary faces 41 and 42. In the embodiment depicted, the three illustrated boundary faces 42 of the material projections 4 are curved convexly on the side facing away from the tube wall. However, in principle, according to the invention each material projection 4 may also have another boundary face 42 or a plurality of boundary faces 42 with a convex curvature. The other, non-convex boundary faces 41 may have either a planar or a concave configuration. The material of the material projections 4 worked out integrally originates primarily from the rib flank 32, recesses 34 occurring due to a displacement of material when the heat exchanger tubes 1 are being produced.

Figure 2:
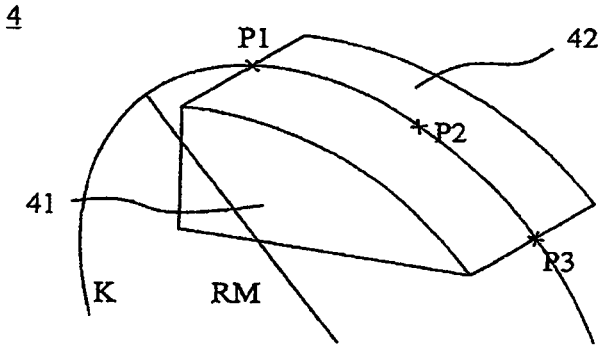
FIG. 2 shows, as a detail, a view of a material projection, illustrated in FIG. 1, with a convexly curved boundary face.

FIG. 2 shows, as a detail, a view of a material projection 4 with a convexly curved boundary face 42. The other, non-convex boundary faces 41 are in this case planar. In the region of the convex surface, the condensate which is precipitated from the gas phase is transported away on account of the surface tension, with the result that condensate accumulates to an increased extent in the region of the concave curvature or else on planar surface regions.

The mean radius of curvature RM of an imaginary circle K of the convex boundary face 42 is defined by the three points P1, P2 and P3. This radius RM may be used as a characterizing dimension for the shape of the convex surface. P1 is the point at which the convex boundary face 42 of the material projection 4 is contiguous to the rib flank, P3 is the point at which the convex boundary face 42 of the material projection 4 is furthest away from the rib flank, and P2 is the center point between P1 and P3 on the contour line of the convex boundary face 42 of the material projection 4. In the case of conventional structural sizes of the heat exchanger tubes according to the invention with integrally rolled ribs, the mean radius of curvature RM typically lies in the submillimeter range.

Figure 3:
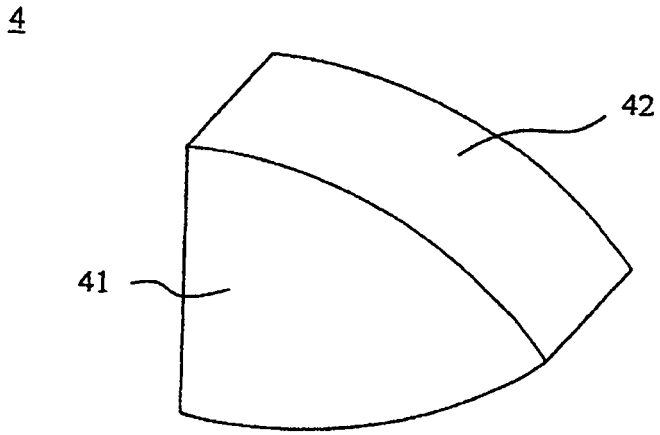
FIG. 3 shows, as a detail, a further view of a material projection with two convexly curved boundary faces.

A further view, as a detail, of a material projection 4 with two mutually opposite convexly curved boundary faces is shown in FIG. 3. By means of this geometry, starting from the tip of a material projection 4, condensate is transported especially effectively toward the rib flank. In principle, all the boundary faces 42, including the side faces 41, could also have a convex curvature for the most efficient embodiment. However, such embodiments are subject to stringent process engineering requirements in terms of the structuring of integral rib forms and their material projections 4.

Figure 4:
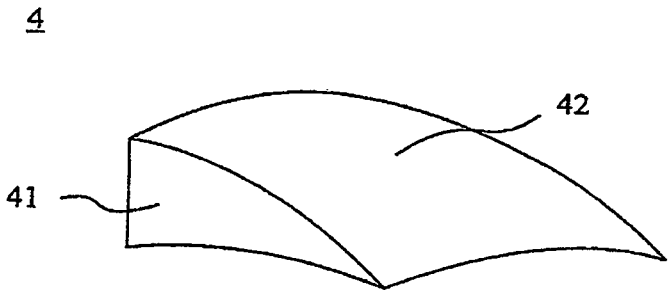
FIG. 4 shows, as a detail, a further view of a material projection with a doubly convexly curved boundary face.

As a further advantageous embodiment, the material projection 4 illustrated in a further view as a detail in FIG. 4 can also be implemented with a doubly convexly curved boundary face 42 and with planar side faces 41. The curvature of the convex boundary face in a plane perpendicular to the flank is in this case greater than the curvature of the convex boundary face 42 in the plane parallel to the rib flank. Surfaces curved in this way additionally assist the flow-off of condensate toward the rib flank.

Figure 5:
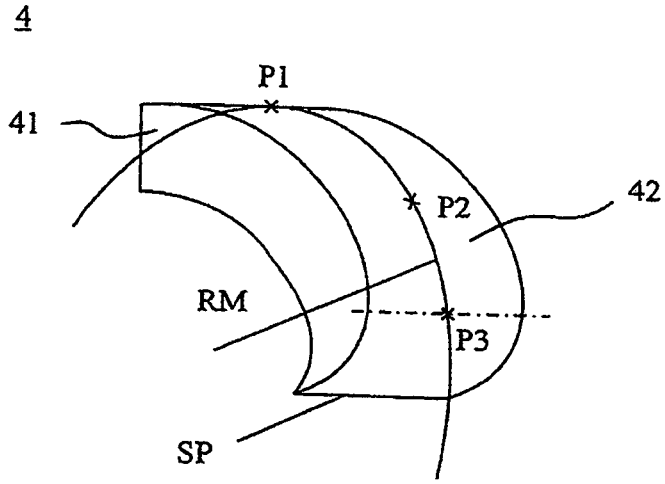
FIG. 5 shows, as a detail, a further view of a material projection with a continuation extending beyond the point furthest away from the rib flank.

A further exemplary embodiment is shown, as a detail, by FIG. 5 in the view of the material projection 4 with planar side faces 41 and with a continuation extending beyond the point P3 furthest away from the rib flank. In this case, the tip SP of the material projection 4 is rolled up spirally toward the rib foot. Further surface condensation is thereby obtained in the available interspace between the ribs. Once again, the mean radius of curvature RM of the convex boundary face 42 of an imaginary circle K is fixed for the points P1, P2 and P3.

Figure 6:
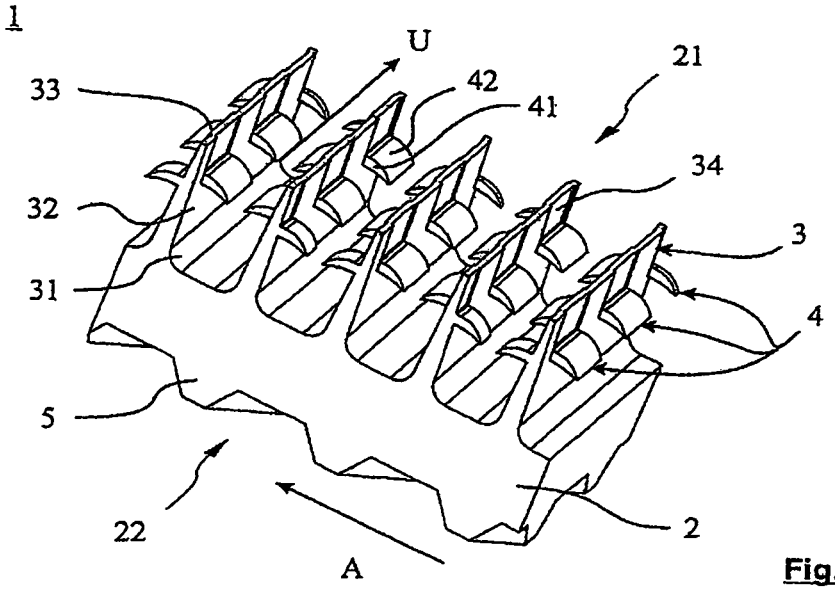
FIG. 6 shows a perspective part view of the outside of a heat exchanger tube portion.
Figure 7:
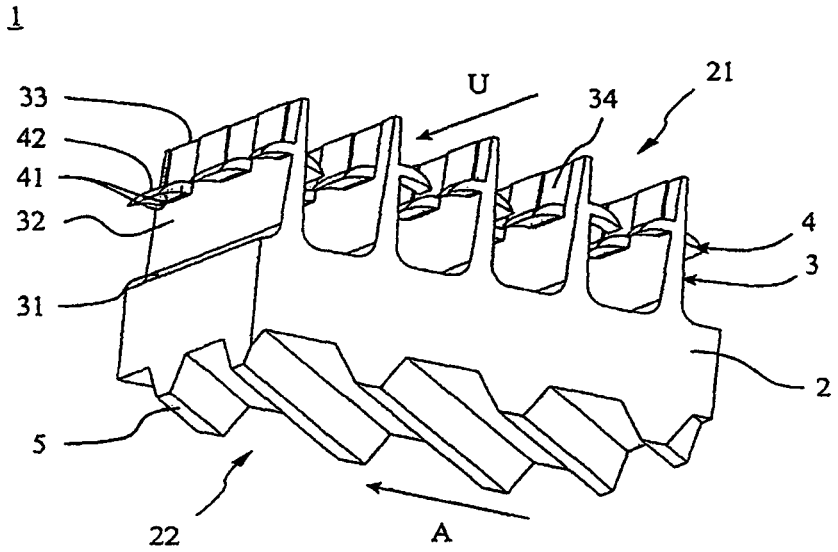
FIG. 7 shows a perspective part view of the inside of a heat exchanger tube portion.

FIG. 6 shows a perspective part view of the outside of a heat exchanger tube portion 1. By contrast, a further perspective part view of the inside of a heat exchanger tube portion is shown in FIG. 7. Some of the integrally formed ribs 3 running around the tube axis A are illustrated on the tube outside 21. The ribs project radially from the tube wall 2 and are connected to the latter via the rib foot 31. Material projections 4 are formed on the rib flanks 32 and start laterally on the rib flanks 32. Of the boundary faces of the material projections 4, the boundary faces 42 facing away from the tube wall 2 are formed convexly. The other, non-convex boundary faces 41 are planar in the embodiment according to FIG. 6. In FIG. 7, the lateral boundary faces 41 are planar, and the boundary faces 41 directed toward the tube interior are shaped concavely. The material of the material projections 4 worked out integrally originates primarily from the rib flank 32 and only partially from the region of the rib tip 33, with the result that recesses 34 are formed. The material projections 4 arranged on the rib flank 32 are spaced apart equidistantly, approximately by the amount of their width, in the circumferential direction U. Opposite material projections of adjacent ribs 3 do not touch one another, since the selected axial extent of the material projections 4 is smaller than half the width of the interspace between two ribs 3. Inner ribs 5 running around spirally are arranged on the tube inside 22 and increase the transfer of heat to the fluid inside the heat exchanger tube 1, as compared with a smooth tube.

Figure 8:
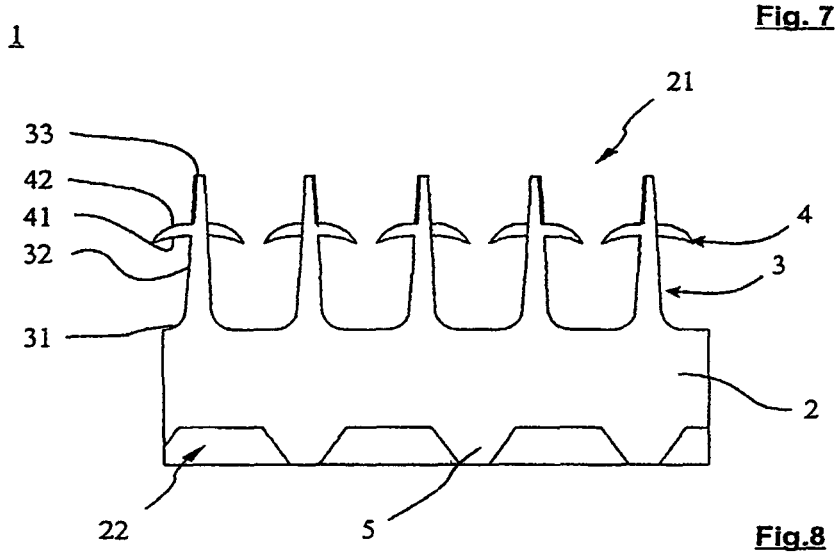
FIG. 8 shows a cross section through a heat exchanger tube portion.

FIG. 8 shows a cross section through a heat exchanger tube portion 1. Inner ribs 5 running around spirally are located on the tube inside 22. The ribs 3 on the tube outside 21 are arranged in a regular sequence, starting from the rib foot 31, perpendicularly on the tube wall 2, and the rib tip 33 is somewhat flattened. The boundary faces 42, facing away from the tube wall 2, of the material projections 4 starting on the rib flank 32 are formed convexly, and the boundary faces 41 directed toward the tube interior 22 are concave. Once again, opposite material projections of adjacent ribs 3 do not touch one another. This affords sufficient space for the accumulating condensate to be transported away.

LIST OF REFERENCE SYMBOLS

1 Heat exchanger tube
2 Tube wall
21 Tube outside
22 Tube inside
3 Rib on the tube outside
31 Rib foot
32 Rib flank
33 Rib tip
34 Recesses
4 Material projection
41 Boundary face
42 Convex boundary face
5 Rib on the tube inside
SP Tip of a material projection
U Tube circumferential direction
A Tube axis
RM Mean radius of curvature
K Circle
P1, P2, P3 points on a convex boundary face

The invention claimed is:

1. A metallic heat exchanger tube (1) for a vapour with a tube wall and with integrally formed ribs which run around on the tube outside and have a rib foot, rib flanks and a rib tip, the rib foot projecting essentially radially from the tube wall, and the rib flanks being provided with additional structural elements which are formed as material projections which are arranged laterally on the rib flank, the material projections having a plurality of boundary faces, characterized in that at least one of the boundary faces of at least one material projection is curved convexly and the local radius of curvature of the convex boundry face is reduced with an increasing distance from the rib flank.

2. The metallic heat exchanger tube according to claim 1, characterized in that the convexly curved boundary face is a boundary face of a material projection which faces away from the tube wall.

3. The metallic heat exchanger tube according to claim 1, characterized in that the curvature of the boundary face is also curved convexly in a plane parallel to the rib flank, the curvature of the convex boundary face in a plane perpendicular to the rib flank being greater than the curvature of the convex boundary face in the plane parallel to the rib flank.

4. The metallic heat exchanger tube according to claim 1, characterized in that the radius (RM) of an imaginary circle (K), which lies in a sectional plane perpendicular to the tube circumferential direction (U) and is defined by the points P1, P2 and P3, is smaller than 1 mm, P1 being the point at which the convex boundary face of the material projection is contiguous to the rib flank, P3 being the point at which the convex boundary face of the material projection is furthest away from the rib flank, and P2 being the center point between P1 and P3 on the contour line of the convex boundary face of the material projection.

5. The metallic heat exchanger tube (1) according to claim 4, characterized in that the convex boundary face of the material projection, in the region of the tip (SP) of the latter, is continued with the convex curvature beyond the point P3 furthest away from the rib flank.

6. The metallic heat exchanger tube (1) according to claim 1, characterized in that the material projections arranged on the rib flank are spaced apart in the circumferential direction (U).

7. The metallic heat exchanger tube (1) according to claim 1, characterized in that the material projections arranged on the rib flank are spaced apart equidistantly and at least by the amount of their width in the circumferential direction (U).

* * * * *